United States Patent [19]

Gray

[11] 4,214,118

[45] Jul. 22, 1980

[54] ELECTRICAL BUSHING

[75] Inventor: Keith I. Gray, LaVerne, Calif.

[73] Assignee: Gould Inc., Rolling Meadows, Ill.

[21] Appl. No.: 721,379

[22] Filed: Sep. 8, 1976

[51] Int. Cl.[2] ..... H01B 17/26

[52] U.S. Cl. ..... 174/15 BH; 174/12 BH; 174/31 R; 174/153 R

[58] Field of Search ..... 174/12 BH, 15 BH, 31 R, 174/153 R

[56] References Cited

U.S. PATENT DOCUMENTS 3,973,077 8/1976 Classon ..... 174/12 BH X

*Primary Examiner*—Laramie E. Askin

*Attorney, Agent, or Firm*—Ostrolenk, Faber, Gerb & Soffen

[57] ABSTRACT

First and second conductive flanges adjacent first and second ends of a hollow insulator column are biased together by a through-rod assembly such that the first and second flanges cooperate with the insulator column to form a substantially enclosed chamber. The through-rod assembly means includes three coaxial cylinders connecting the first conductive flange to the second conductive flange. The innermost cylinder is connected to the first conductive flange and extends internally into the enclosed chamber. An external shoulder extends from the distal end of the first cylinder and supports one end of a second cylinder. The remaining end of the second cylinder terminates at an internal flange extending from the distal end of a third cylinder which extends from the second conductive flange. The coefficient of thermal expansion of the through-rod assembly is chosen such that the effective coefficient of thermal expansion of the through-rod assembly is approximately equal to the coefficient of thermal expansion of the hollow insulator column.

17 Claims, 3 Drawing Figures

ELECTRICAL BUSHING

BACKGROUND OF THE INVENTION

The present invention relates to electrical bushings. More particularly, the present invention relates to gas filled bushings for introducing high voltage conductors into a housing, such as a gas filled circuit breaker.

In bushings of the foregoing type, the central conductor serves both a mechanical and electrical function. In addition to providing an electrical connection between the conductive flanges on either side of the hollow dielectric housing, the conductor provides the mechanical connection for holding the bushing together. In order to be certain that the central conductor serves both functions properly, it is necessary to design the bushings to accommodate relative expansion or dimensional changes between the metallic central conductor and the porcelain insulative housing due to thermal expansion and contraction. This is a major problem since bushings of the present type are ordinarily subjected to wide ranges of temperatures and since the coefficients of thermal expansion of the metallic conductor and porcelain housing are quite divergent.

The standard solution of this problem has been to provide a spring assembly connecting the central conductor to one of the two conductive flanges. Bushings of this type are illustrated in U.S. Pat. No. 3,566,001 and will be described in some detail with reference to FIG. 1, below.

BRIEF DESCRIPTION OF THE INVENTION

The present invention eliminates the need for spring type systems of the prior art by providing a unique through-rod assembly, the effective coefficient of thermal expansion of which is approximately equal to the coefficient of thermal expansion of the hollow insulator column within which the through-rod assembly is situated.

In the preferred embodiment, the through-rod assembly comprises first, second and third coaxial cylinder which cooperate to bias first and second conductive flanges, located adjacent first and second ends of a hollow insulator column, against their respective ends of the insulator column. The innermost of the three cylinders is connected at one end to the first conductive flange and extends internally into the insulator column. An external shoulder extends from the distal end of the first cylinder and supports one end of the second cylinder. The remaining end of the second cylinder terminates at an internal flange extending from the distal end of a third cylinder which is connected to the second conductive flange.

The coefficient of thermal expansion of the through-rod assembly is chosen such that the effective coefficient of thermal expansion thereof is approximately equal to the coefficient of thermal expansion of the hollow insulator column. By way of example, the coefficient of thermal expansion of the second cylinder will be slightly less than twice as great as the coefficient of thermal expansion of the first and third cylinders. Since the coefficient of thermal expansion of the hollow insulator column is typically low, the effective coefficient of thermal expansion of both elements will be approximately equal and both elements will expand or contract an equal distance during normal temperature excursions.

A significant feature of the present invention is that any suitable flexible conductor may be utilized to electrically connect the first and second conductive flanges on either end of the insulator column. When such an arrangement is utilized, the conductor is not subjected to any mechanical load and can be made from the most suitable material in terms of current carrying capacity.

BRIEF DESCRIPTION OF THE DRAWINGS

For the purpose of illustrating the invention, there is shown in the drawing a form which is presently preferred; it being understood, however, that this invention is not limited to the precise arrangements and instrumentalities shown.

DETAIL DESCRIPTION OF THE INVENTION

Figure 1:
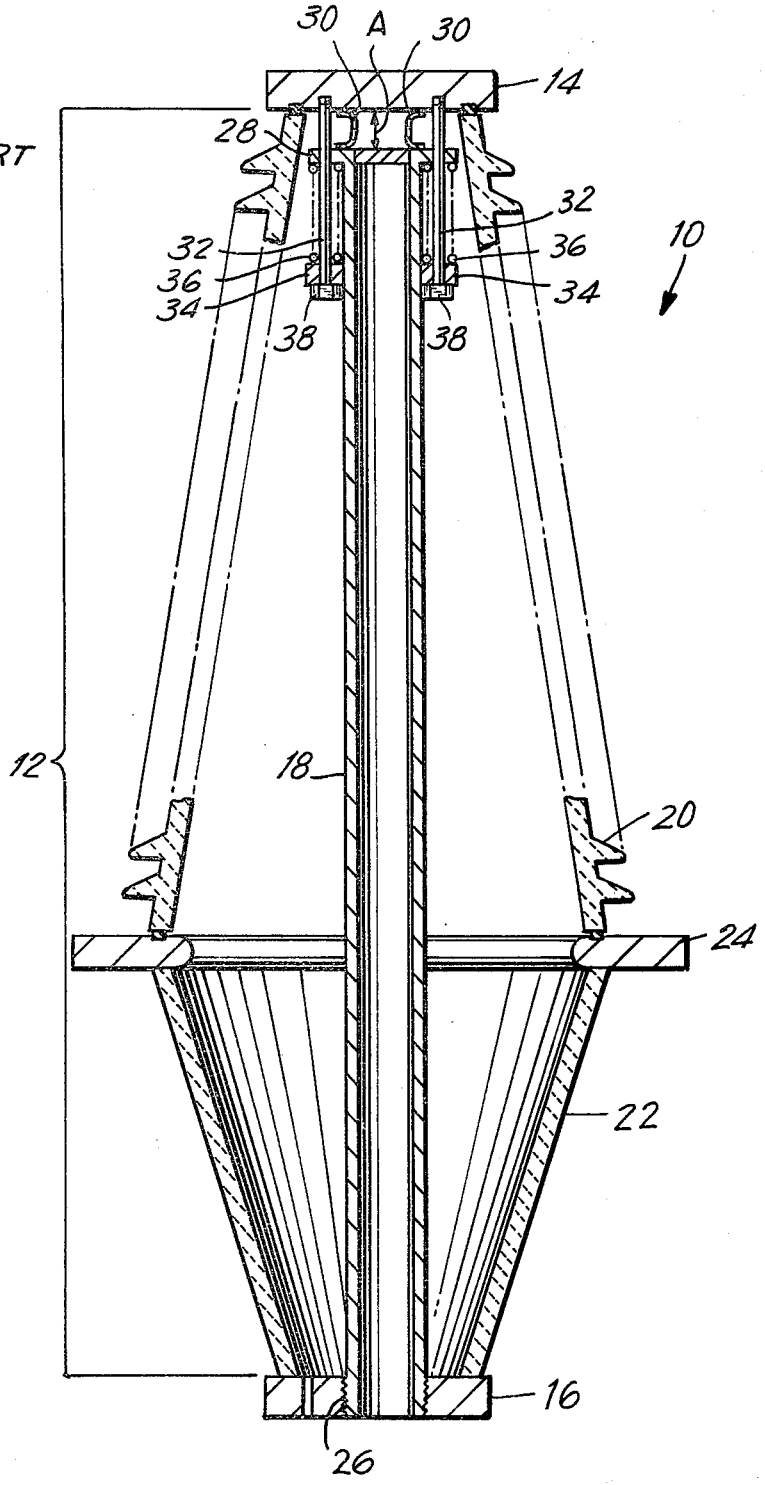
FIG. 1 PRIOR ART
FIG. 1 is a plan cross-sectional view of a prior art bushing.

Referring now to the drawings wherein like numerals indicate like elements there is shown in FIG. 1 a typical prior art gas-filled bushing 10. Bushing 10 consists of an insulator housing 12, a pair of conductive flanges 14 and 16 and a central conductor 18.

Insulator housing 12 comprises two conical insulator columns 20 and 22 which are separated by an annular mounting flange 24. The sections of insulator housing 12 are biased together by central conductor 18 which applies a tensile force to conductive flanges 14 and 16.

Central conductor 18 is threaded at 26 and connected to conductive flange 16 in a manner described below. The distal end of conductor 18 is provided with an external flange 28 which is electrically connected to conductive flange 14 by flexible conductors 30. External flange 28 is mechanically connected to conductive flange 14 by a spring assembly comprising studs 32, rings 34 and springs 36. Studs 32 depend from conductive flange 14 and terminate at expanded heads 38. Head 38 of each stud 32 supports a ring 34 of sufficient size to seat one end of spring 36. Springs 36 are compression springs and force conductive flanges 14 and 16 inwardly towards annular mounting flange 24. The particular force exerted as well as the distance "A" between external step 28 and conductive flange 14 is adjusted by tightening conductive flange 16 about the threaded end 26 of central conductor 18.

In the foregoing bushing, the force applied to flanges 14 and 16 by springs 36 varies for different operating temperatures particularly when the length of the insulator column increases for increased voltage rating. As the operating temperature increases, the length of central conductor 18 increases at a faster rate than the length of insulator housing 12 causing the length of springs 36 to increase. The converse is, of course, also true. Since the spring rate is a function of the length of the spring and the length of the spring is a function of temperature, the spring rate will vary for varying operational temperatures. In practical applications, this requires that the force exerted by the springs be excessively high when the conductor 18 is at its shortest length to insure adequate force when the conductor 18 is at its maximum length.

In the prior art design the central conductor 18 also serves both a mechanical and electrical function. Thus its material must be chosen such that the central conductor can withstand both the tensile forces applied thereto during the normal operation and at the same time, have the highest possible conductivity.

Figure 2:
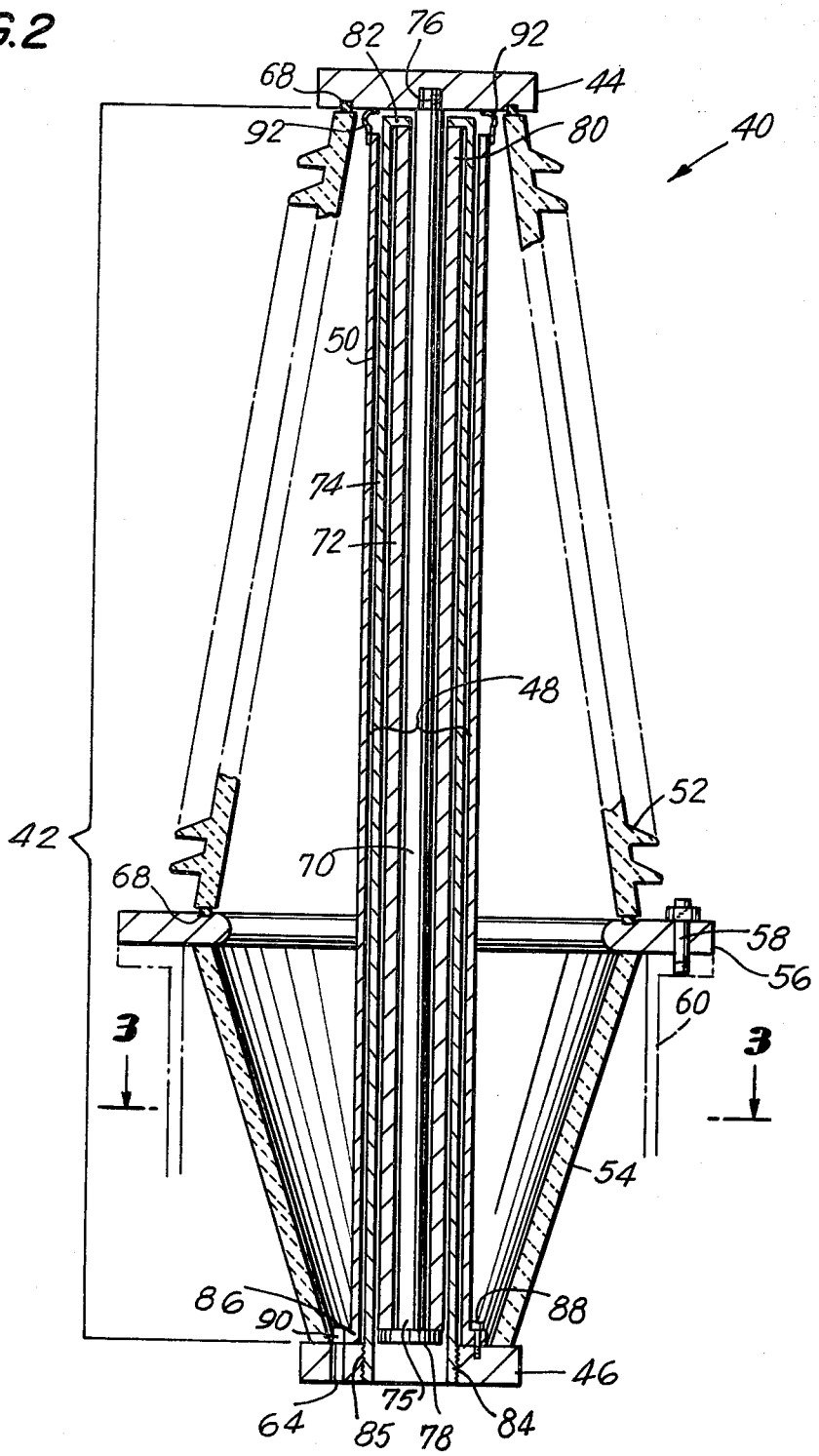
FIG. 2 is a plan cross-sectional view of a bushing constructed in accordance with the principles of the present invention.
Figure 3:
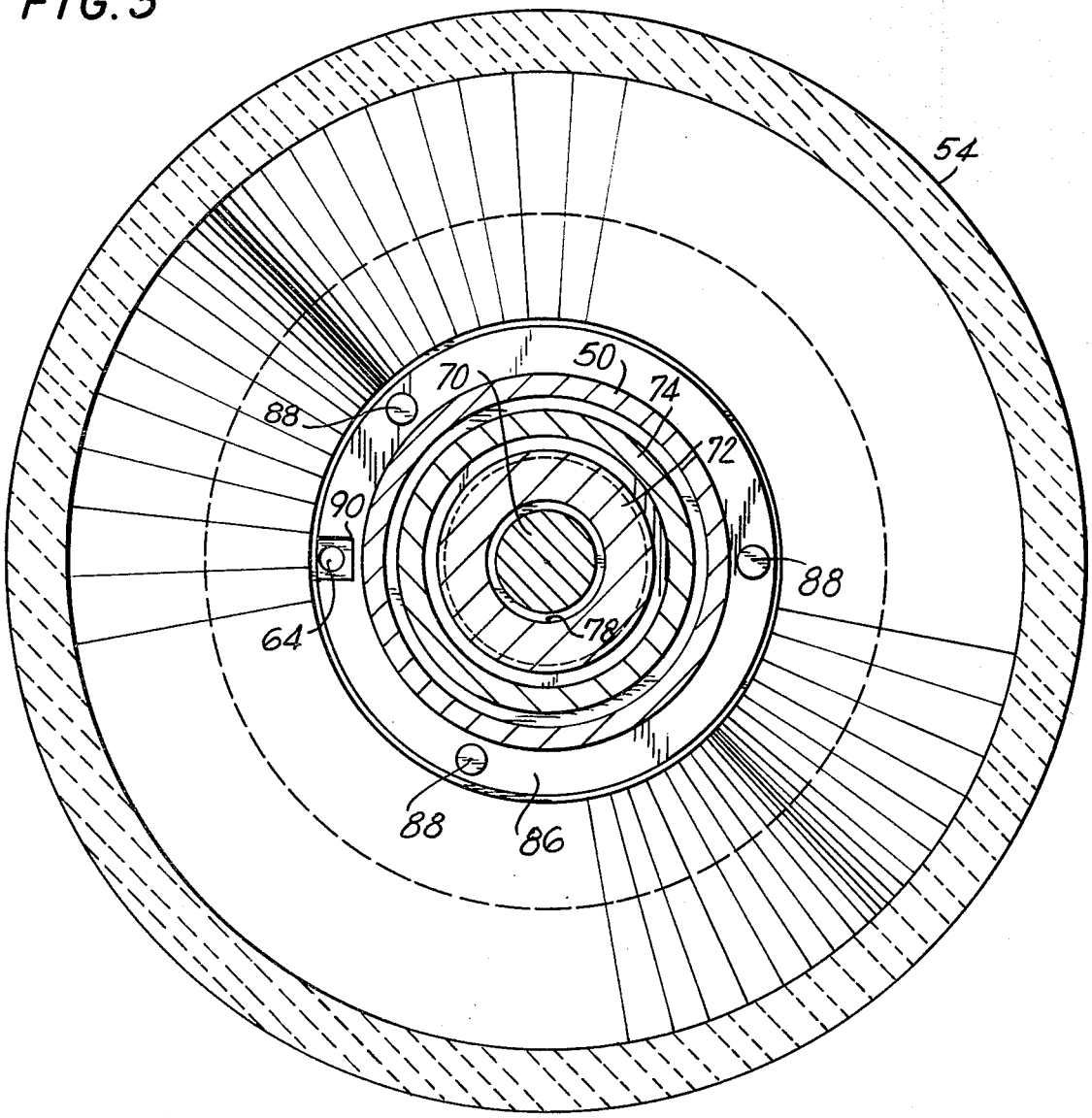
FIG. 3 is a cross-sectional view of the bushing of FIG. 2 taken along line 3—3 of FIG. 2.

Referring now to FIGS. 2 and 3, there is illustrated a new bushing design constructed in accordance with the principles of the present invention and designated generally as 40. Bushing 40 comprises five major components; insulator housing 42, conductive flanges 44 and 46, through-rod assembly 48 and conductor 50. Insulator housing 42 consists of two insulator columns 52 and 54 which may be of any standard configuration and which are joined in end-to-end relation through an annular mounting flange 56. Columns 52 and 54 are normally made of porcelain but may be constructed of any other suitable insulative material. The annular mounting flange 56 is of the standard type and contains numerous bolt hole openings, such as bolt hole 58, which permit bushing 40 to be mounted to any suitable enclosure such as the fragmentarily shown enclosure 60 which could, for example, represent the sealed housing of a gas circuit breaker. When so mounted, the entire insulator column 54 is immersed within the enclosure, and the insulator housing 42 may also be gas filled.

Bushings of the type disclosed herein may be rated at extremely high voltages, for example, 550 kV and above. For this reason, it is desirable to fill bushing 40 with an insulation gas such as sulfur hexafluoride to properly insulate annular mounting flange 56 (which will normally be grounded) from the high voltage conductor 50. To this end, conductive flange 46 may be provided with an aperture 64 which permits gas to communicate between the enclosure 60 into bushing 40.

Since insulator column 52 is positioned above the exterior of enclosure 60, seals 68 are provided between flanges 44 and 56 and insulator column 52. Suitable seals are described in U.S. Pat. No. 3,566,001, assigned to the assignee of the present invention.

Conductive flanges 44, 46 are situated adjacent opposite ends of insulator housing 42 and are biased towards each other by through-rod assembly 48. Through-rod assembly 48 comprises three cylindrical rods 70, 72 and 74 which clamp the two flanges 44, 46 to insulator housing 42 with a sufficiently high force to insure a sound mechanical design. Specifically, the force which must be exerted by the through-rod assembly 48 must be sufficiently great to overcome the following loads: (1) load due to gas pressure within bushing 40, (2) load due to wind forces, (3) load due to line pulls, (4) load due to short circuit forces, and (5) load imposed during a seismic event.

The innermost cylindrical rod 70 is fitted into an appropriately threaded opening 76 in conductive flange 44 and extends internally into insulator housing 42. The distal end 75 of cylindrical rod 70 is provided with an external flange 78 which supports cylindrical rod 72. Cylindrical rod 72 is coaxial with cylindrical rod 70 and, as will be shown below, cooperates with cylindrical rods 70 and 74 to act as a spring member which biases conductive flanges 44, 46 together. The upper end 80 of cylindrical rod 72 abuts an internal flange 82 on the distal end of cylindrical rod 74. The proximal end 84 of cylindrical rod 74 is externally threaded and mates with an internally threaded aperture 85 in conductive flange 46. The desired force between conductive flanges 44 and 46 is adjusted by rotating conductive flange 46 on the threaded end 84 of cylindrical rod 74. As conductive flange 46 is rotated, cylindrical rod 74 is drawn away from conductive flange 44 and cylindrical rod 72 is compressed between flanges 78 and 82. This increases the tensile force applied to conductive flanges 44, 46 by through-rod assembly 48 and makes it possible to adjust the force with which flanges 44, 46 press against housing 42.

Significantly, the effective length of through-rod assembly 48 is approximately three times the length of the bushing. This length provides an effective spring rate which, although relatively high, keeps the force to be used on assembly to an acceptable level. Particularly, the force required is such that under the worst temperature conditions the force generated by through-rod assembly 48 is the minimum required to overcome the externally applied loads described above.

Although through-rod assembly 48 is normally metallic, and therefore provides an electrical connection between conductive flanges 44 and 46, it is preferable to provide a separate conductor, such as cylindrical conductor 50, to electrically connect flanges 44, 46. In the embodiment illustrated in the drawings, conductor 50 is a cylinder of extremely high conductivity which is coaxial to rod assembly 48. One end of cylindrical conductor 50 includes an external flange 86 which is bolted to conductive flange 46 by appropriate fasteners 88. As best seen in FIG. 3, flange 86 is provided with a notch 90 which is coextensive with aperture 64. Although conductor 50 serves no mechanical function, it still must accommodate dimensional changes in the bushing structure. Accordingly, a plurality of flexible connectors 92 connect conductor 50 to conductive flange 44. While conductor 50 has been shown as a cylindrical conductor, any other suitable arrangement could be utilized without departing from the spirit of scope of the present invention.

It should be obvious from the foregoing, that the full mechanical load between flanges 44 and 46 is applied to through rod assembly 48 and that conductor 50 may be designed with only electrical characteristics in mind. Accordingly, conductor 50 may be made of any material exhibiting high conductivity regardless of the relative strength of such material. Similarly, through-rod assembly 48 can be designed with only mechanical characteristics in mind. Accordingly, the cylindrical rods 70, 72, 74 can be made from any material exhibiting high tensile strength.

As noted above, bushing 40 will normally be subjected to large temperature excursions due to both ambient conditions and $I^2R$ losses within the bushing itself. Since bushings of the type described herein are often used in high voltage applications in the 550 kV range and above, in hostile environments the temperature excursions can be quite extreme. The insulator housing 42 is normally made of porcelain for its good insulative characteristics. The through-rod assembly will normally be made of metallic elements for their strength and good spring characteristics. The coefficient of thermal expansion of porcelain is relatively low while that of metals is relatively high. If this variance is not compensated for, the structural integrity of the bushing will be jeopardized.

To avoid this possibility, the thermal coefficients of expansion of cylindrical rods 70, 72, 74 are chosen such that the overall coefficient of thermal expansion of through-rod assembly 48 is approximately equal to the coefficient of thermal expansion of insulator housing 42. In this manner, the pressure applied by conductive flanges 44 and 46 against the ends of insulator housing 42 will remain approximately constant over the entire range of operating temperatures of bushing 40. In the embodiment illustrated in FIG. 2, cylindrical rod 72 is chosen to have a coefficient of thermal expansion which is slightly less than twice the coefficient of thermal expansion of cylindrical rods 70 and 74, the coefficient of thermal expansion of the latter two rods being essentially identical. By this arrangement, the distance between conductive flanges 44 and 46 will be permitted to increase an amount approximately equal to the distance between the two ends of insulator housing 42 during any temperature excursion and the force applied by flanges 44 and 46 against insulator housing 42 will remain approximately constant.

Although this invention has been described with respect to the preferred embodiment, it should be understood that many variations in modifications will now be obvious to those skilled in the art, and, therefore, the scope of this invention is limited not by the specific disclosure herein, but only by the appended claims.

What is claimed is:

1. An electrical bushing comprising:

an elongated, hollow insulator column having first and second ends, said insulator column having a first coefficient of thermal expansion;

a first conductive flange adjacent said first end of said insulator column;

a second conductive flange adjacent said second end of said insulator column;

through-rod assembly means for biasing said first conductive flange towards said second conductive flange such that said first and second conductive flanges cooperate with the insulator column to form a substantially enclosed chamber whose axial length is defined by the distance between said conductive flanges; said through-rod assembly means comprising a plurality of elements, at least two of said elements having differing coefficients of thermal expansion, said elements arranged in such a manner that the effective coefficient of thermal expansion of said through-rod assembly means in the direction of said axial length of said chamber is approximately equal to the effective coefficient of thermal expansion of said insulator column in the direction of said axial length of said chamber.

2. An electrical bushing in accordance with claim 1 wherein said through-rod assembly means comprises:

a first member connected to said first conductive flange and extending into said enclosed chamber, said first member including a flange projecting therefrom;

a second member connected to said second conductive flange and extending into said enclosed chamber, said member including a flange projecting therefrom, said flange projecting from said second member being closer to said first conductive flange than said flange projecting from said first member;

a third member supported between said flange projecting from said first member and said flange projecting from said second member.

3. An electrical bushing in accordance with claim 2 wherein the coefficient of thermal expansion of said third member is slightly less than twice the coefficient of thermal expansion of said first and second members.

4. An electrical bushing in accordance with claim 3 wherein said first, second and third members are coaxial cylinders and said third member is disposed between said first and second members.

5. An electrical bushing in accordance with claim 4 including a conductive element, separate and distinct from said through-rod assembly means, for electrically connecting said first conductive flange to said second conductive flange.

6. An electrical bushing in accordance with claim 5 wherein said conductive element comprises a fourth cylindrical member coaxial with said first, second and third cylindrical members.

7. An electrical bushing in accordance with claim 1 including a conductive element, separate and distinct from said through-rod assembly means, for electrically connecting said first conductive flange to said second conductive flange.

8. An electrical bushing in accordance with claim 7 wherein the material of said conductive element is chosen for its electrical characteristics and wherein the material of said through-rod assembly means is chosen for its mechanical characteristics.

9. An electrical bushing comprising:

an elongated, hollow insulator column having first and second ends, said insulator column having a first coefficient of thermal expansion; a first conductive flange adjacent said first end of said insulator column;

a second conductive flange adjacent said second end of said insulator column;

a through-rod assembly for biasing said first conductive flange towards said second conductive flange such that said first and second conductive flanges cooperate with said insulator column to form a substantially enclosed chamber whose axial length is defined by the distance between said conductive flanges;

said through-rod assembly comprising first, second and third coaxial cylindrical rods, said first cylindrical rod connected to said first conductive flange and extending into said enclosed chamber, said second cylindrical rod connected to said second conductive flange and extending into said chamber, said third cylindrical rod disposed between said first and second cylindrical rods, the ends of said third cylindrical rod abutting external and internal flanges projecting from said first and second cylindrical rods, respectively, the coefficients of thermal expansion of said first, second and third rods being chosen such that the overall coefficient of thermal expansion of said through-rod assembly in the direction of said axial length of said chamber is approximately equal to the effective coefficient of thermal expansion of said insulator column in the direction of said axial length of said chamber.

10. An electrical bushing in accordance with claim 9 including a conductive element, separate and distinct from said through-rod assembly, for electrically connecting said first flange to said second flange.

11. An electrical bushing in accordance with claim 10 wherein said conductive element is a fourth cylindrical rod coaxial with said first, second and third cylindrical rods.

12. Bushing for leading an electrical connector through a wall or the like, comprising an intermediate flange for attachment in the wall, two metallic end flanges arranged on either side of the intermediate flange and two hollow insulating bodies clamped between the intermediate flange and the end flanges, and a bushing conductor running the length of the whole bushing, said bushing conductor being movable in relation to at least one of the end flanges, and a drawing member connected between the end flanges comprising a first and a second elongated metallic body, each of which is attached at one end to a corresponding end flange, said bodies overlapping each other for a certain distance, and a pressure-transmitting member forming a power-transmitting connection between the ends of the metallic bodies which are not connected to the end flanges.

13. Bushing according to claim 12, in which said insulating bodies are of ceramic material and said pressure-transmitting member is made of a material with greater average thermal expansion per unit of length than said first and second metallic bodies.

14. Bushing according to claim 13, in which said pressure-transmitting member consists of a third elongated metallic body.

15. Bushing according to claim 14, in which said first, second and third elongated metallic bodies are in the form of three coaxial cylinders, of which said third metallic body is a hollow cylinder positioned radially between the other bodies.

16. Bushing according to claim 12, in which said bushing conductor substantially consists of a tube which surrounds said drawing member.

17. Bushing according to claim 16, in which said tube together with a metal cylinder included in said drawing member limits a hollow-cylindrical space, which communicates, through circulation openings for coolant, with a space located radially outside said tube.

* * * * *